US006140965A

United States Patent [19]

Van Hoozen

[11] Patent Number: 6,140,965

[45] **Date of Patent: *Oct. 31, 2000**

[54] BROAD BAND PATCH ANTENNA

[75] Inventor: Allen Lee Van Hoozen, Schaumburg, Ill.

[73] Assignee: Northrop Grumman Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/073,718

[22] Filed: May 6, 1998

[51] Int. Cl.[7] ..... H01Q 1/38

[52] U.S. Cl. ..... 343/700 MS; 343/814; 343/833; 343/834; 343/853

[58] Field of Search ..... 343/700 MS, 817, 343/818, 815, 833, 834, 853, 814; H01Q 1/38

[56] References Cited

U.S. PATENT DOCUMENTS

| | | | |
|---|---|---|---|
| Re. 29,911 | 2/1979 | Munson | 343/700 |
| 3,534,372 | 10/1970 | Scheuerecker et al. | 343/742 |
| 3,683,390 | 8/1972 | Cory et al. | 343/792.5 |
| 3,696,437 | 10/1972 | Grant | 343/792.5 |
| 3,990,079 | 11/1976 | Epis | 343/771 |
| 4,063,249 | 12/1977 | Bergander et al. | 343/756 |
| 4,117,489 | 9/1978 | Kaloi | 343/700 |
| 4,163,236 | 7/1979 | Kaloi | 343/700 |
| 4,170,012 | 10/1979 | Kaloi | 343/700 |
| 4,243,993 | 1/1981 | Lamberty et al. | 343/895 |
| 4,326,203 | 4/1982 | Kaloi | 343/700 |
| 4,364,050 | 12/1982 | Lopez | 343/700 |
| 4,401,988 | 8/1983 | Kaloi | 343/700 |
| 4,445,122 | 4/1984 | Pues | 343/700 |
| 4,450,449 | 5/1984 | Jewitt | 343/700 |
| 4,594,595 | 6/1986 | Struckman | 343/770 |
| 4,608,572 | 8/1986 | Blakney et al. | 343/792 |
| 4,761,654 | 8/1988 | Zaghloul | 343/700 |
| 4,835,538 | 5/1989 | McKenna et al. | 343/700 |
| 4,849,765 | 7/1989 | Marko | 343/702 |
| 4,864,314 | 9/1989 | Bond | 343/700 |
| 4,907,011 | 3/1990 | Kuo | 343/792.5 |
| 4,943,809 | 7/1990 | Zaghloul | 343/700 |
| 5,005,019 | 4/1991 | Zaghloul et al. | 343/700 |
| 5,008,681 | 4/1991 | Cavallaro et al. | 343/700 |
| 5,021,796 | 6/1991 | Corzine et al. | 343/712 |
| 5,111,211 | 5/1992 | Dahlberg | 343/700 |
| 5,124,713 | 6/1992 | Mayes et al. | 343/700 |
| 5,164,738 | 11/1992 | Walter et al. | 343/789 |
| 5,187,490 | 2/1993 | Ohta et al. | 343/700 |
| 5,191,351 | 3/1993 | Hofer et al. | 343/895 |
| 5,210,541 | 5/1993 | Hall et al. | 343/700 |
| 5,212,494 | 5/1993 | Hofer et al. | 343/859 |
| 5,220,335 | 6/1993 | Huang | 343/700 |
| 5,231,406 | 7/1993 | Sreenivas | 343/700 |
| 5,309,163 | 5/1994 | Ngan et al. | 343/700 |
| 5,313,216 | 5/1994 | Wang et al. | 343/700 |
| 5,315,753 | 5/1994 | Jensen et al. | 29/600 |
| 5,376,942 | 12/1994 | Shiga | 343/700 |
| 5,382,959 | 1/1995 | Pett et al. | 343/700 |
| 5,400,040 | 3/1995 | Lane et al. | 343/700 |
| 5,400,041 | 3/1995 | Strickland | 343/700 |
| 5,410,323 | 4/1995 | Kuroda | 343/700 |
| 5,448,250 | 9/1995 | Day | 343/700 |
| 5,448,252 | 9/1995 | Ali et al. | 343/700 |
| 5,453,751 | 9/1995 | Tsukamoto et al. | 343/700 |

(List continued on next page.)

*Primary Examiner*—Don Wong
*Assistant Examiner*—Shih-Chao Chen
*Attorney, Agent, or Firm*—Terry J. Anderson; Karl J. Hoch, Jr.

[57] ABSTRACT

A patch antenna having enhanced frequency response has a generally planar element formed of a substantially conductive material, and antenna feed conductor electrically connected to the antenna element, and a generally planar parasitic element formed of a substantially conductive material positioned substantially coaxially with respect to the antenna element and spaced apart therefrom. The distance by which the parasitic element is spaced apart from the antenna element in order to provide such enhanced frequency response of the patch antenna is determined empirically. An optimally configured array of such patch antennas is also disclosed.

18 Claims, 4 Drawing Sheets

U.S. PATENT DOCUMENTS

| | | | |
|---|---|---|---|
| 5,471,220 | 11/1995 | Hammers et al. | 342/372 |
| 5,471,664 | 11/1995 | Kim | 455/323 |
| 5,477,231 | 12/1995 | Medard | 343/700 |
| 5,483,678 | 1/1996 | Abe | 455/80 |
| 5,497,164 | 3/1996 | Croq | 343/700 |
| 5,506,592 | 4/1996 | MacDonald et al. | 343/846 |
| 5,510,803 | 4/1996 | Ishizaka et al. | 343/700 |
| 5,565,875 | 10/1996 | Buralli et al. | 343/700 |
| 5,572,222 | 11/1996 | Mailandt et al. | 343/700 |
| 5,576,718 | 11/1996 | Buralli et al. | 343/700 |
| 5,594,455 | 1/1997 | Hori et al. | 343/700 |
| 5,657,028 | 8/1997 | Sanad | 343/700 |
| 5,680,144 | 10/1997 | Sanad | 343/700 |
| 5,686,841 | 11/1997 | Stolarczyk et al. | 324/635 |
| 5,703,601 | 12/1997 | Nalbandian et al. | 343/700 |

BROAD BAND PATCH ANTENNA

FIELD OF THE INVENTION

The present invention relates generally to radio antennas and more particularly to a very broad band patch antenna which may be configured for use in either circularly or linearly polarized radio frequency communication systems. Also disclosed is an array of such patch antennas, wherein the feed lines associated therewith are configured so as to simplify the routing thereof upon a printed wiring board.

BACKGROUND OF THE INVENTION

Patch antennas for use in radio communications are known. Such patch antennas may be utilized in applications wherein it is undesirable to have an antenna which extends substantially from the surface of an object. As those skilled in the art will appreciate, patch antennas generally conform to the surface of the object upon which they are mounted, and thus do not extend substantially therefrom.

Because they are generally flat mounted, patch antennas find particular application in aircraft, wherein it is undesirable to have antennas extend from the surface of the fuselage and/or wings. Not only does the extension of such antennas from the aircraft provide both increased aerodynamic drag and radar cross section, but they are also obtrusive such that they are subject to damage during routine maintenance operations. They also impede maintenance personnel during such routine maintenance operations and/or cleaning of the aircraft.

However, as those skilled in the art will further appreciate, such patch antennas generally provide a comparatively narrow frequency response, thereby limiting their use to various specific applications. Thus, although the use of such narrow band patch antennas has been beneficial for specific applications, the narrow bandwidth of contemporary patch antenna has substantially diminished their utility. For example, typically a particular patch antenna may only be utilized to effect the desired one of voice communications, telemetry, remote control, etc. Additional dedicated, narrow band patch antennas must typically be utilized for each individual desired application.

In view of the forgoing, it is apparent that a single, broad frequency response patch antenna is desirable. The broadband patch antenna would be suitable for use in voice communications, telemetry, remote control, etc., across a comparatively wide range of frequencies.

SUMMARY OF THE INVENTION

The present invention specifically addresses and alleviates the above mentioned deficiencies in the prior art. More particularly, the prior art comprises a method for forming a patch antenna having enhanced frequency response. The method comprises the steps of providing a generally planar antenna element formed of a substantially conductive material; providing an antenna feed conductor which is electrically connected to the antenna element; providing a generally planar parasitic element formed of substantially conductive material positioned substantially coaxially with respect the antenna element and spaced apart therefrom; and empirically determining the distance by which the parasitic element is spaced apart from the antenna element so as to provide enhanced frequency response of the patch antenna.

The distance by which the parasitic element is spaced apart from the antenna element is empirically determined by performing the steps of: varying the distance between the parasitic element and the antenna element; and measuring the frequency response of the patch antenna at different distances, so as to determine the approximate distance at which the frequency response of the patch antenna is the greatest.

Preferably, computer modeling of the patch antenna with the parasitic element spaced apart from the antenna element thereof is performed at different distances, so as to provide a rough estimate of the distance between the parasitic element and the antenna element which provides the greatest frequency response of the patch antenna. This distance is then included in the range of distances utilized when measuring the frequency response of the antenna at different distances.

Those skilled in the art will appreciate that merely utilizing the distance derived via computer modeling is not likely to provide the best results, since it is extremely difficult to account for all of the parameters which must be included so as to accurately calculate this distance. For example, the exact dielectric permattivity and the exact magnetic permeability of the various materials utilized in the construction of the patch antenna can be difficult to determine, due to unavoidable variations in the compositions of these materials, as well as variations in the thicknesses thereof when they are utilized during the fabrication process. As such, the distance provided by such computer modeling is merely a starting point around which empirical data must be taken in order to find the actual optimal spacing of the parasitic element from the antenna element.

According to the preferred embodiment of the present invention, the step of providing a generally planar parasitic element comprises providing a parasitic element having a size and shape approximately the same as the size and shape of the antenna element. Thus, the parasitic element corresponds substantially in configuration to the antenna element, preferably being identical thereto, with the exception that the parasitic element lacks an antenna feed conductor. In this manner, the overall size of the patch antenna is minimized.

Those skilled in the art will appreciate that broad band frequency response may be achieved in contemporary patch antennas by increasing the surface area of the parasitic element. However, when the surface area of the parasitic element is increased in this manner, the overall size of the patch antenna is substantially increased, thereby inhibiting use of such patch antenna in many desired applications, particularly those requiring a closely spaced array of such patch antennas.

According to the preferred embodiment of the present invention, the step of providing the generally planar antenna element comprises providing a generally rectangular, planar antenna element and the step of providing the generally planar parasitic element similarly comprises providing a generally rectangular, planar parasitic element.

As those skilled in the art will appreciate, patch antennas may be suitable for the reception and transmission of either circularly polarized electromagnetic radiation or linearly polarized electromagnetic radiation, depending upon the dimensions of the patch antenna. In either instance, the patch antenna is generally rectangular in shape. However, when the patch antenna is to be utilized with circularly polarized electromagnetic radiation, then the patch antenna is generally square in configuration, with one dimension thereof being only slightly longer than the other, perpendicular, dimension thereof. When the patch antenna is to be utilized for the reception and transmission of linearly polarized, i.e., horizontally or vertically polarized, electromagnetic radiation, then one dimension of the rectangular patch antenna is substantially longer than the other, perpendicular, dimension thereof.

For circularly polarized patch antennas, the feed conductor is electrically connected to the antenna element proximate a corner thereof, so as to facilitate reception and transmission of circularly polarized electromagnetic radiation. Conversely, when patch antennas which are to be utilized with linearly polarized electromagnetic radiation, the feed conductor is electrically connected to the antenna element proximate the center of one edge of the patch antenna, so as to facilitate reception and transmission of linearly polarized electromagnetic radiation.

Optionally, an array of such patch antennas may be formed so as to enhance the gain provided thereby. As those skilled in the art will appreciate, enhanced reception of weak signals may be provided by enhancing the gain of an antenna system, typically by adding antenna elements and/or parasitic elements to the antenna system. According to the preferred embodiment of the present invention, a two dimensional array is defined by a plurality of generally rectangular patch antennas. Such a two dimensional array of patch antennas is preferably configured as a rectangular array comprising a plurality of rows and columns.

According to the present invention, the array of rows and columns is configured such that within a given column of the array all of the patch antennas have a common orientation, i.e., the long sides of the rectangular patch antennas within the given column are all parallel. Further, according to the present invention, the orientation of the patch antennas in adjacent columns is different. That is, the long side of each patch antenna in one row is generally perpendicular to the long side of a patch antenna in an adjacent column. Thus, the patch antennas of adjacent columns point in different, orthogonal directions. Such construction may be utilized in either circularly or linearly polarized antenna systems. By configuring the individual patch antennas of such an array in this manner, the configuration of the conductive conduits or printed wiring board traces utilized to form the feed conductors for the antenna is substantially simplified, thereby facilitating easier, less costly design and production of the array and also allowing the individual patch antennas to be more closely spaced with respect to one another. The feed conductors can thus be arranged to extend away from a 2×6 array of patch antennas, so as to eliminate the need for traces between antennas.

Thus, according to the preferred embodiment of the present invention, the feed conductors of such an array are electrically connected to each patch antenna within a given column at like location with respect to each patch antenna in that particular column. That is, if for example, one patch antenna within a given column has the feed conductor attached to the lower left corner thereof, then all of the patch antennas within that column have the feed conductor attached to the lower left corner thereof. According to the preferred embodiment of the present invention, the generally rectangular patch antennas are approximately square and the antenna feed conductors are electrically connected thereto at a corner thereof so as to facilitate transmission and reception of circularly polarized electromagnetic radiation therewith.

Alternatively, the generally rectangular patch antennas have one side thereof substantially longer than the other side thereof and the antenna feed conductors are electrically connected thereto approximate a center of one side thereof, so as to facilitate transmission and reception of linearly polarized electromagnetic radiation therewith.

Further, according to the preferred embodiment of the present invention, the array comprises two columns and six rows. The antennas in one column are oriented such that a long side thereof extends generally parallel to the direction of the column and the antennas in the other column are oriented such that along side thereof extends generally perpendicular to the direction of the column.

Thus, the present invention provides a broad frequency response patch antenna which is suitable for use in various applications such as voice communications, telemetry, remote control, etc., across a comparatively wide range of frequencies.

DETAILED DESCRIPTION OF THE INVENTION

The detailed description set forth below in connection with the appended drawings is intended as a description of the presently preferred embodiments of the invention, and is not intended to represent the only forms in which the present invention may be constructed or utilized. The description sets forth the functions and the sequence of steps for constructing and operating the invention in connection with the illustrated embodiments. It is to be understood, however, that the same or equivalent functions may be accomplished by different embodiments that are also intended to be encompassed within the spirit and scope of the invention.

Figure 1:
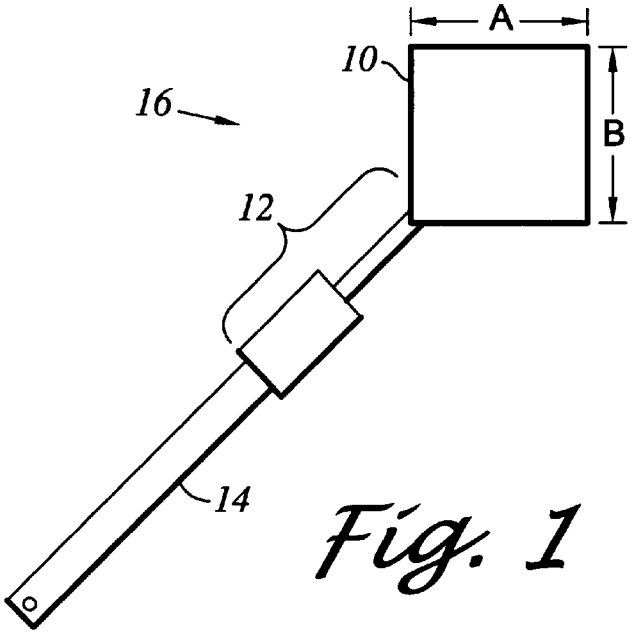
FIG. 1 shows a representative circularly polarized very broad band patch antenna formed according to the present invention.

A circularly polarized, very broadband patch antenna of the present invention is shown in FIG. 1. Although the present invention is shown and discussed herein as a circularly polarized, very broadband patch antenna, those skilled in the art will appreciate that the present invention is likewise suitable for use in linearly polarized patch antennas. Thus, illustration and discussion of the present invention as a circularly polarized patch antenna is by way of example only and is not by way of limitation.

As shown in FIG. 1, the circularly polarized, very broadband patch antenna comprises an antenna element 10 which, according to the preferred embodiment of the present invention is formed as a copper cladding or trace via contemporary printed wiring board (PWB) techniques, wherein copper is either built up onto or etched away from a non-conductive substrate. That is, the antenna elements, the parasitic elements, and the antenna feed conductors of the present invention are preferably formed utilizing contemporary techniques such as those commonly used in the manufacture of printed wiring boards for computers, consumer electronics, etc.

The antenna element has a first side dimension A which is slightly shorter than a second side, dimension B, thereof. According to the preferred embodiment of the present invention the short side, dimension A is approximately 1.084 inch in length and the long side, dimension B is approximately 1.127 inch in length.

Feed conductor 14 attaches, via impedance matching transformer or balun 12 to a corner of the antenna element 10. Those skilled in the art will appreciate that such antenna feed conductors 14 attach to antenna elements at a corner thereof for circularly polarized antennas and attached to antenna elements proximate the middle of one side thereof for linearly polarized antennas. As those skilled in the art will further appreciate, the use of multiple antenna elements substantially enhances the gain of a given antenna system.

Figure 2:
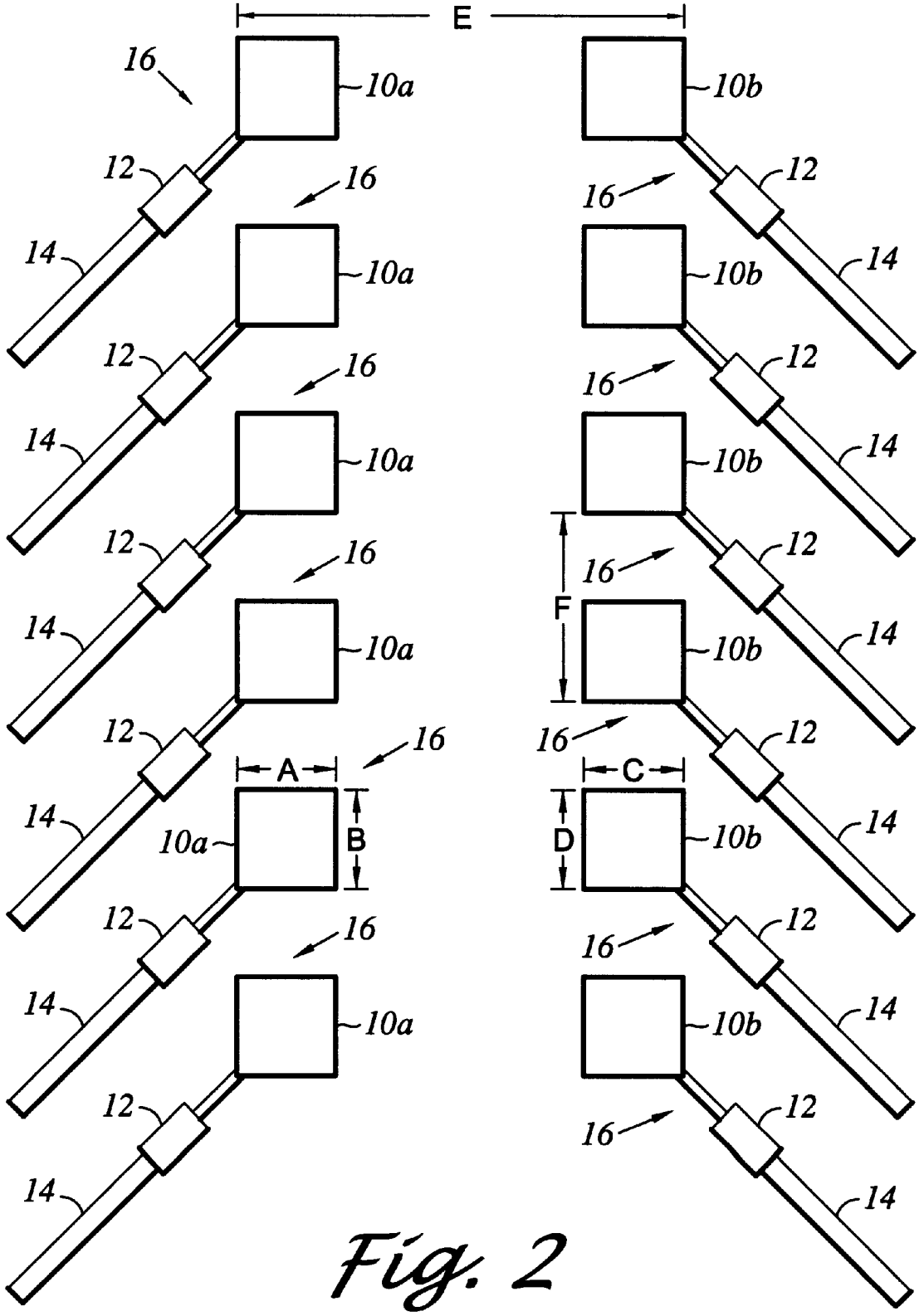
FIG. 2 shows a 2×6 array of circularly polarized, very broad band patch antennas, such as those of FIG. 1.

Referring now to FIG. 2, a plurality of patch antennas 16 are arranged in a 2×6 array and are oriented such that the feed conductors 14 associated therewith all extend outwardly, away from the array. Forming the antennas into an array substantially enhances, the gain of the antenna system according to well known principles.

Such configuration of the feed conductors 14 is accomplished by configuring the array such that a long side, dimension B, of the antenna elements 10*a* extend parallel to the direction of the column, i.e., in the same direction as the column and a short side, dimension A extends perpendicularly with respect thereto.

The antenna elements 10*b* of the second column of the array are all oriented orthogonally with respect to the antenna elements 10*a* of the first column. Thus, the antenna elements 10*b* of the second column are oriented such that the long side, dimension C thereof, is oriented generally perpendicularly with respect to the direction of the column and the short side of each antenna element 10*b* extends parallel to, i.e., in the direction of, the column.

Such orientation of the antenna elements 10*a*, 10*b* of the array allows the feed conductors 14 associated therewith to attach to the antenna elements 10*a*, 10*b* at the lower outboard corners thereof so as to facilitate efficient layout of the printed wiring board (PWB) upon which they are formed. An alternative configuration of the feed conductors is provided in FIGS. 4 and 5, discussed in detail below.

Figure 3:
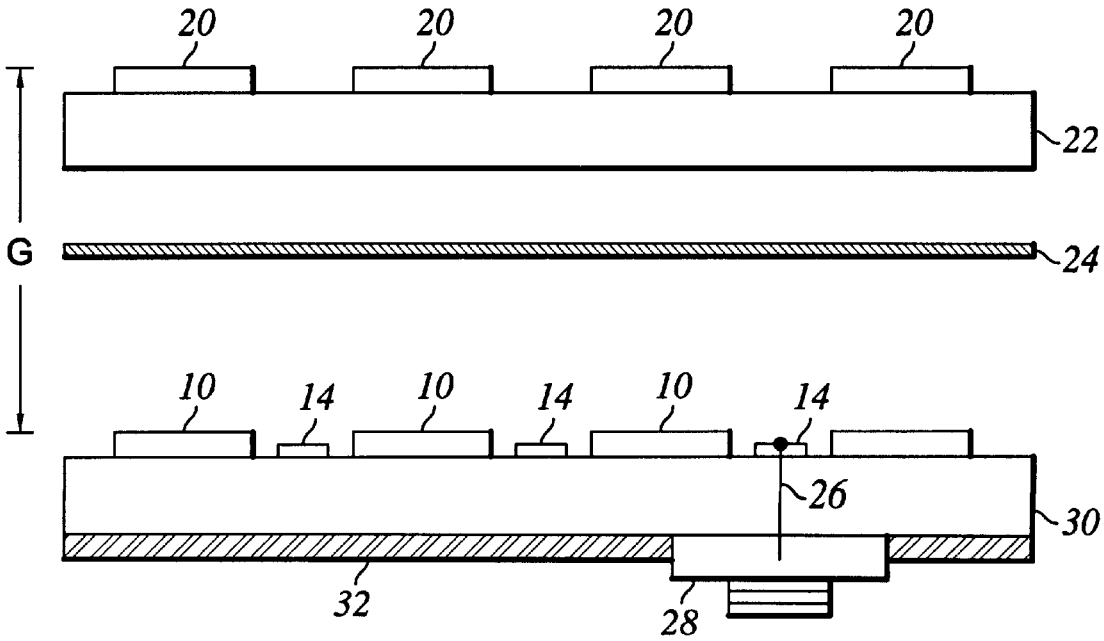
FIG. 3 is an exploded fragmentary side view, showing four of the circularly polarized, very broad band patch antennas of FIG. 2, wherein the thickness of the copper traces is exaggerated for clarity.

Referring now to FIG. 3, parasitic elements 20 are formed generally in laminar juxtaposition to the antenna elements 10, 10*a*, 10*b* (of FIGS. 1 and 2, respectively) so as to enhance the gain and broaden the frequency response thereof.

According to the preferred embodiment of the present invention, the parasitic elements 20 are formed upon a substrate or printed wiring board (PWB) 22 and the antenna elements 10, as well as their associated feed conductors 14 are similarly formed upon printed wiring board (PWB) 30. Dielectrical material 24, preferably 7628 prepreg, preferably having a thickness of approximately 0.0067 inch, separates the two printed wiring boards 22, 30 and provides adhesive therebetween.

Copper plating or ground plane 32 is formed upon the opposite side of printed wiring board 30.

Via 26 provides electrical connection between the network of feed conductors 14 and connector 28 which facilitates connection of the array to a radio receiver and/or transmitter.

As those skilled in the art will appreciate, the spacing, dimension G, between the antenna elements 10 and the parasitic elements 20 substantially determines the performance of the antenna array. More particularly, the spacing, dimension G, substantially affects the bandwidth or frequency response of each antenna element 10.

Those skilled in the art will appreciate that an attempt may be made to determine the optimal spacing, i.e., that spacing which provides the broadest frequency response, merely via calculation or computer modeling. However, those skilled in the art will further appreciate that such calculational computer modeling is subject to substantial errors due to indeterminate factors such as the actual compositions of the various materials, i.e., the printed wiring boards (PWBs) prepreg, etc., utilized to fabricate the antenna assembly, as well as differences between the specified and actual dimensions thereof. Further, such calculations or computer modeling inherently makes various assumptions regarding the environment, (i.e., electrical characteristics of the area in which the antenna is used). Of course, it is rare that these specifications and assumptions are actually true, thus causing any such calculated or computer modeled result to be substantially different from the actual distance, dimension G, which provides the optimal, i.e., broadest, frequency response for the antenna system.

Thus, according to the present invention, the distance, dimension G, between the antenna elements 10 and the parasitic elements 20 is determined empirically. Such empirical determination of the distance, dimension G, involves constructing the antenna such that the distance, dimension G, between the antenna elements 10 and the parasitic elements 20 may be adjusted while monitoring the performance of the antenna. The materials utilized in the antenna, as well as those in the immediate environment thereof, are duplicated as closely as possible, so as to provide the desired accuracy of the determination of the distance, dimension G, between the antenna elements 10 and the parasitic elements 23.

Thus, according to the present invention, the distance, dimension G, between the antenna elements 10 and the parasitic elements 20 is actually varied so as to determine that distance which provides the greatest frequency response of the antenna assembly. Then, this dimension is utilized in the actual construction of the antenna.

Optionally, a calculated or computer modeled distance is utilized as the nominal distance, i.e., that distance at which the empirical determination of the distance, dimension G, is commenced. Thus, the result of such calculational computer modeling determines the center point or starting distance about which empirical measurements are made.

Those skilled in the art will appreciate that the reception and transmission of electromagnetic radiation occurs at the opposite side of the printed wiring board 30 from that upon which the ground plane 32 is formed.

Figure 4:
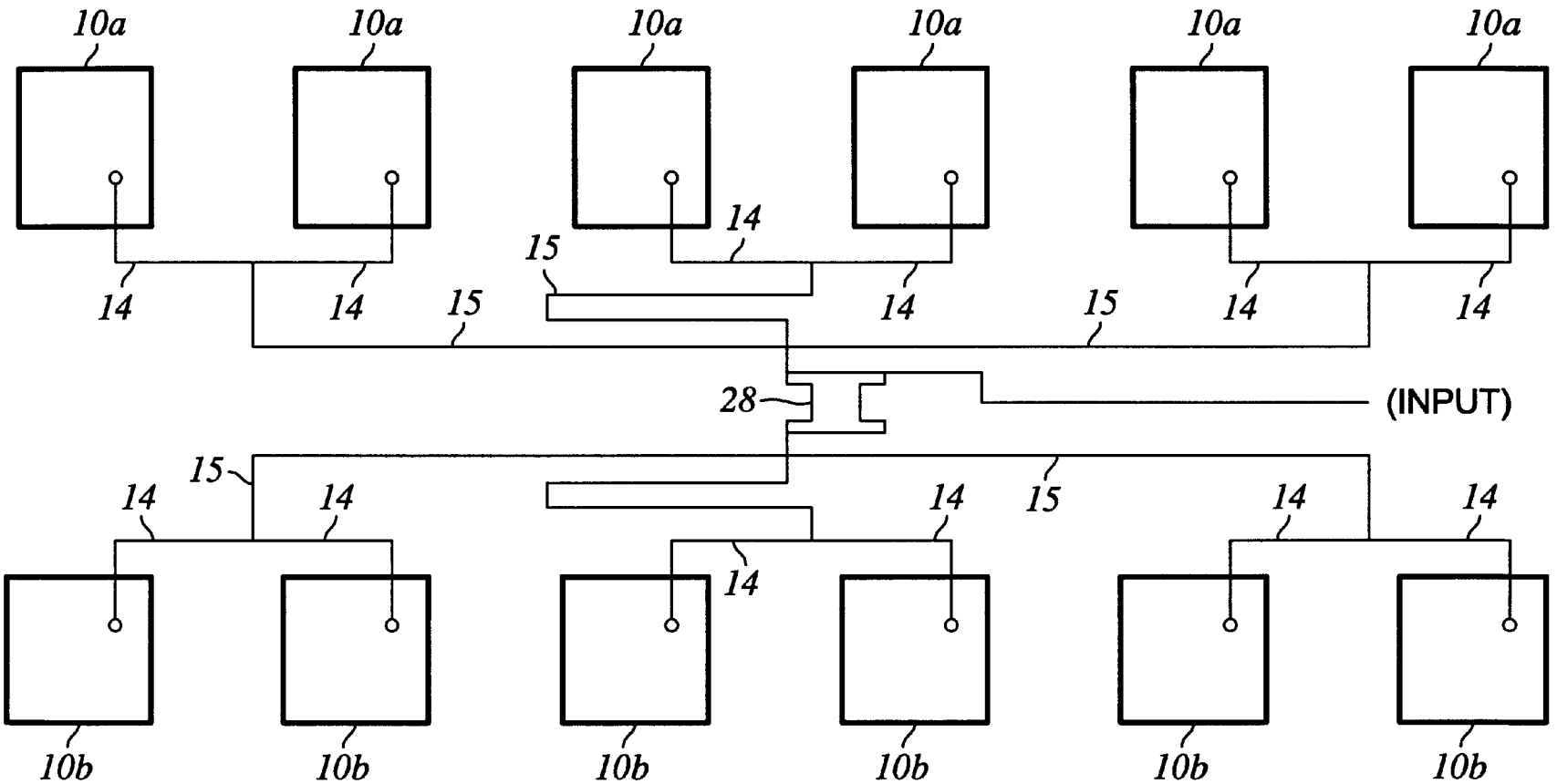
FIG. 4 is a schematic representation of a 2×6 array of circularly polarized, very broadband patch antennas similar to those of FIG. 2, and also showing an optimized routing of the feed conductors formed upon a printed wiring board and electrically connected thereto.

Referring now to FIG. 4, one preferred configuration for routing the feeds 14 of the antenna elements 10*a*, 10*b* is shown. According to this preferred embodiment of the present invention, the feeds 14 from each antenna element 10*a*, 10*b* electrically connect to secondary feeds 15 which attach to output line connector or coaxial connector 28. As shown in FIG. 4, the lengths of the antenna feeds 14 and the secondary feeds 15 are approximately equal to one another. Thus, some of the secondary feeds 15 loop so as to maintain the length thereof, such that it is equal to the other secondary feeds 15. Those skilled in the art will appreciate that it is desirable to maintain the length of the antenna feeds 14 approximately equal to one another and to maintain the length of the secondary feeds 15 approximately equal to one another, so as to maintain a desirable phase relationship among the antenna elements 10*a*, 10*b* at the coaxial connector 28.

Figure 5:
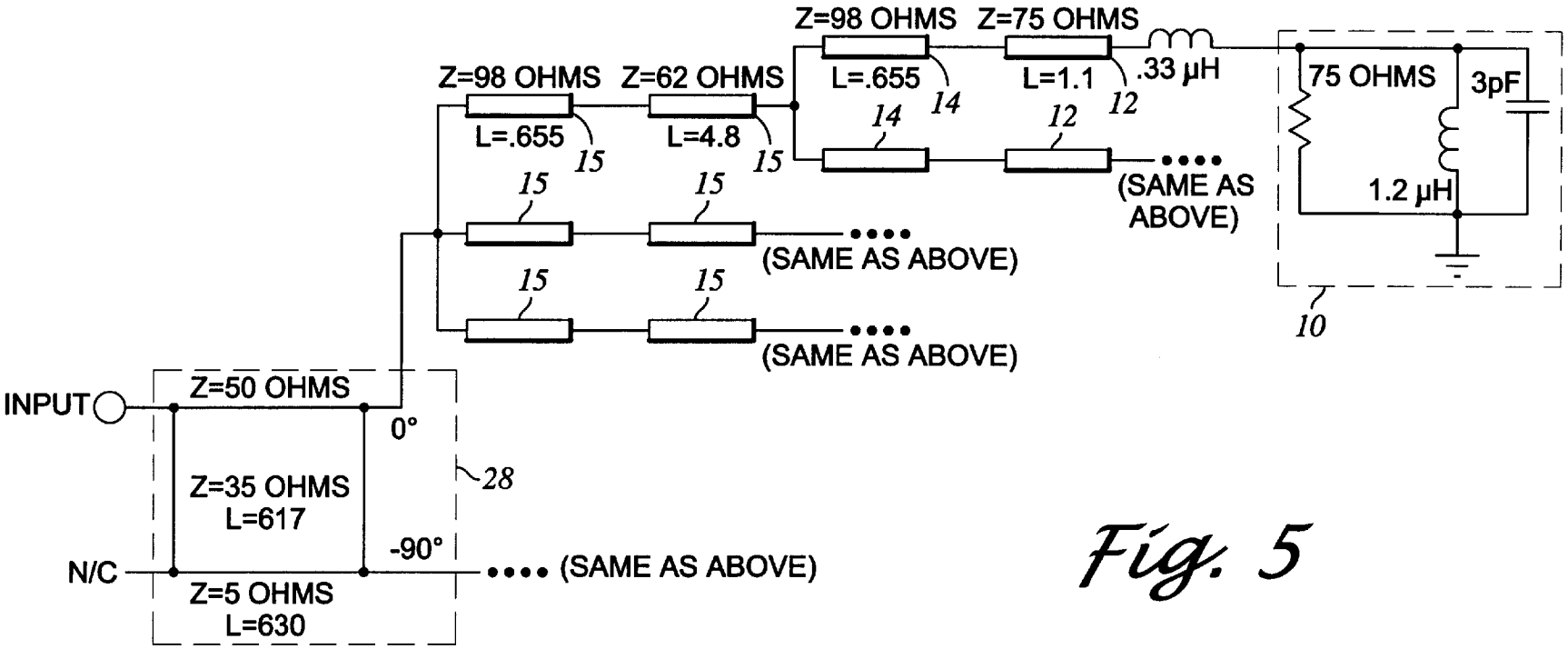
FIG. 5 is a schematic representation of the patch feed network of FIG. 4 showing the inductances and impedances associated therewith.

Referring now to FIG. 5, the inductances and impedances of the various elements of the antenna system of FIGS. 2–4 is shown. For example, the lumped element model of patch antenna 10 is represented as a resistance of 75 ohms, a inductance of 1.2 henrys, and a capacitance of 3 pico farads. In a similar manner, the inductances and impedances of the baluns 12, the conductors 14, secondary feeds 15, and coaxial connector 28 are shown.

It is understood that the exemplary patch antenna described herein and shown in the drawings represents only presently preferred embodiments of the invention. Indeed, various modifications and additions may be made to such embodiments without departing from the spirit and scope of the invention. For example, the antenna element and the parasitic element, as well as any conductive traces such as the antenna feed and/or balun, may be comprised of any desired conductive material, such as but not limited to silver, gold, platinum, tin, lead, carbon, etc. Further, those skilled in the art will appreciate that various other substrates, other than printed wiring boards (PWBs), may be suitable. Thus, these and other modifications and additions may be obvious to those skilled in the art may be implemented to adapt the present invention for use in a variety of different applications.

What is claimed is:

1. A broad band patch antenna array comprising:

a plurality of generally rectangular patch antennas, each of the patch antennas having a first side and a second side longer than the first side;

the patch antennas being arranged in a first column wherein the first sides of the patch antennas are in generally co-planar relation to one another, and a second column wherein the second sides of the patch antennas are aligned in generally opposed, parallel relation to the first sides of the patch antennas of the first column such that the patch antennas of the second column are orthogonal to the patch antennas of the first column; and a plurality of antenna feed conductors each having an equal length, each of the antenna feed conductors being electrically connected to a respective one of the patch antennas within a given column at a corresponding location;

wherein the equal length of the antenna feed conductors and the orthogonal orientation of the patch antennas of the second column to the patch antennas of the first column facilitate the reception and transmission of electromagnetic radiation in two planes.

2. The antenna array of claim 1 wherein both the first and second columns comprise six patch antennas.

3. The antenna array of claim 1 wherein the length of the first side of each patch antenna is longer than the length of the second side thereof for reception and transmission of linearly polarized electromagnetic radiation.

4. The antenna array of claim 1 wherein the length of the first side of each patch antenna is equal to the length of the second side thereof for reception and transmission of circularly polarized electromagnetic radiation.

5. The antenna array of claim 1 wherein the antenna feed conductor is electrically connected to each of the patch antennas at a corner thereof for reception and transmission of circularly polarized electromagnetic radiation.

6. The antenna array of claim 1 wherein the antenna feed conductor is electrically connected to each of the patch antennas at a midpoint of a respective first side for reception and transmission of linearly polarized electromagnetic radiation.

7. The antenna array of claim 1 wherein each of the patch antennas comprise:

a generally planar antenna element formed of a conductive material electrically connected to the antenna feed conductor; and a generally planar parasitic element formed of a conductive material disposed in spaced coaxial relation to the planar antenna element;

wherein the distance between the antenna element and the parasitic element is selected to maintain optimal electromagnetic coupling between the parasitic element and the antenna element for a prescribed frequency bandwidth and gain of the antenna.

8. The antenna array of claim 7 wherein the antenna element has a size and shape equal to a size and shape of the parasitic element.

9. The antenna array of claim 8 wherein the antenna element and the parasitic element have a generally rectangular shape.

10. A method of forming a patch antenna array having enhanced frequency response with a plurality of generally rectangular patch antennas each having a first side and a second side longer than the first side, the method comprising the steps of:

a) aligning the patch antennas into a first column wherein the first sides of the patch antennas are in generally co-planar relation to one another;

b) attaching a respective antenna feed conductor to a corresponding location of a respective patch antenna in the first column, each of the antenna feed conductors having an equal length;

c) aligning the patch antennas into a second column wherein the second sides of the patch antennas are aligned in generally opposed, parallel relation to the first sides of the patch antennas of the first column such that the patch antennas of the second column are orthogonal to the patch antennas of the first column; and d) attaching a respective antenna feed conductor to a corresponding location of a respective patch antenna in the second column, each of the antenna feed conductors having an equal length.

11. The method of claim 10 wherein step (a) comprises aligning six patch antennas in the first column and step (b) comprises aligning six patch antennas in the second column.

12. The method of claim 10 wherein the length of the first side of each patch antenna is longer than the length of the second side thereof for transmission and reception of linearly polarized electromagnetic radiation.

13. The method of claim 10 wherein the length of the first side of each patch antenna is equal to the length of the second side thereof for transmission and reception of circularly polarized electromagnetic radiation.

14. The method of claim 10 wherein step (b) comprises attaching the antenna feed conductor at a corner of the patch antennas of the first column and step (d) comprises attaching the antenna feed conductor at a corner of the patch antennas of the second column.

15. The method of claim 10 wherein step (b) comprises attaching the antenna feed conductor to the midpoint of a respective side of each of the patch antennas of the first column and step (d) comprises attaching the antenna feed conductor to the midpoint of a respective side of each of the patch antennas of the second column.

16. The method of claim 10 wherein each of the patch antennas comprise:

a generally planar antenna element formed of a conductive material electrically connected to the antenna feed conductor; and a generally planar parasitic element formed of a conductive material disposed in spaced coaxial relation to the planar antenna element;

wherein the distance between the antenna element and the parasitic element is selected to maintain optimal electromagnetic coupling between the parasitic element and the antenna element for a prescribed frequency bandwidth and gain of the antenna.

17. The method of claim 16 wherein the antenna element has a size and shape equal to a size and shape of the parasitic element.

18. The method of claim 17 wherein the antenna element and the parasitic element have a generally rectangular shape.

* * * * *